US007118472B2

(12) United States Patent
Kennedy et al.

(10) Patent No.: US 7,118,472 B2
(45) Date of Patent: Oct. 10, 2006

(54) CONTROL SYSTEM FOR PNEUMATICALLY-POWERED DOOR INSTALLATION

(76) Inventors: William R. Kennedy, P.O. Box 138, Taylorville, IL (US) 62568; John Matthew Kennedy, P.O. Box 138, Taylorville, IL (US) 62568

( * ) Notice: Subject to any disclaimer, the term of this patent is extended or adjusted under 35 U.S.C. 154(b) by 0 days.

(21) Appl. No.: 11/139,191

(22) Filed: May 27, 2005

(65) Prior Publication Data

US 2005/0217074 A1 Oct. 6, 2005

Related U.S. Application Data

(62) Division of application No. 10/608,900, filed on Jun. 27, 2003, now Pat. No. 6,938,372.

(51) Int. Cl.
*E21F 1/14* (2006.01)
*E05F 15/00* (2006.01)

(52) U.S. Cl. ..... 454/169; 454/168; 49/138; 16/49; 16/66

(58) Field of Classification Search ..... 49/138, 49/118, 360, 368, 367, 349; 16/49, 51, 56, 16/58, 66; 454/168, 169
See application file for complete search history.

(56) References Cited

U.S. PATENT DOCUMENTS 1,716,707 A * 6/1929 Schoelkopf ..... 49/138
2,550,349 A * 4/1951 Helz ..... 49/138
2,564,067 A * 8/1951 Karp ..... 49/30
2,618,365 A * 11/1952 Seagren ..... 49/137
2,748,855 A * 6/1956 Seims et al. ..... 49/168
2,891,514 A * 6/1959 Moeller ..... 91/42
2,918,890 A 12/1959 Gail
2,926,012 A * 2/1960 Maher ..... 49/68
3,125,232 A * 3/1964 Brinkman et al. ..... 49/68
3,883,014 A 5/1975 Glomski et al.
3,894,477 A 7/1975 Tomikawa
3,921,335 A 11/1975 Hewitt et al.
3,936,977 A * 2/1976 Runft et al. ..... 49/137
3,940,877 A 3/1976 Slaybaugh
4,094,158 A * 6/1978 LeVere et al. ..... 405/303
4,510,714 A 4/1985 Kasper et al.
4,765,346 A 8/1988 Simin
4,911,577 A 3/1990 Kennedy et al.
4,915,540 A 4/1990 Kennedy et al.
4,967,444 A 11/1990 Korling et al.
RE34,053 E 9/1992 Kennedy et al.
5,168,667 A 12/1992 Kennedy et al.

(Continued)

OTHER PUBLICATIONS

Jack Kennedy Metal Products & Buildings, Inc., Kennedy Power Machine Doors brochure, Jul. 2, 2002.

(Continued)

*Primary Examiner*—Hugh B. Thompson, II
(74) *Attorney, Agent, or Firm*—Senniger Powers

(57) ABSTRACT

A mine door installation has a frame installed in a mine passageway. At least one door leaf is mounted on the frame for swinging movement between open and closed positions. Movement of the door leaf is powered by a pneumatic actuator. A pneumatically-powered control system may be provided to control the door installation. The pneumatic control system may comprise a calibrated vent to shorten the delay in the response of the door leaf to direction from the control system to stop moving. The pneumatic control system may also comprise a limit valve to prevent the door installation from opening when a second door installation is open, thereby preventing both door installations in an air lock from being open at the same time.

6 Claims, 13 Drawing Sheets

U.S. PATENT DOCUMENTS

| | | | | |
|---|---|---|---|---|
| RE34,220 | E | 4/1993 | Kennedy et al. | |
| 5,222,838 | A | 6/1993 | Kennedy et al. | |
| 5,240,349 | A | 8/1993 | Kennedy et al. | |
| 5,412,916 | A | 5/1995 | Kennedy et al. | |
| 5,466,187 | A | 11/1995 | Kennedy et al. | |
| 5,515,649 | A | 5/1996 | Strab | |
| 5,651,162 | A | 7/1997 | Keszthelyi | |
| 5,771,635 | A | 6/1998 | Skinner | |
| 5,795,367 | A | 8/1998 | Kennedy et al. | |
| 5,812,741 | A | 9/1998 | Kennedy et al. | |
| 6,032,986 | A | 3/2000 | Kennedy et al. | |
| RE36,853 | E | 9/2000 | Kennedy et al. | |
| 6,164,871 | A | 12/2000 | Kennedy et al. | |
| 6,220,785 | B1 | 4/2001 | Kennedy et al. | |
| 6,256,946 | B1 | 7/2001 | Kennedy et al. | |
| 6,264,549 | B1 | 7/2001 | Kennedy et al. | |
| 6,279,315 | B1 * | 8/2001 | Harju | 60/410 |
| 6,379,084 | B1 | 4/2002 | Kennedy et al. | |
| 6,386,147 | B1 | 5/2002 | Fransen | |
| 6,394,707 | B1 | 5/2002 | Kennedy et al. | |
| 6,419,324 | B1 | 7/2002 | Kennedy et al. | |
| 6,425,820 | B1 | 7/2002 | Kennedy et al. | |
| 6,457,906 | B1 | 10/2002 | Kennedy et al. | |
| 6,594,954 | B1 * | 7/2003 | Kennedy et al. | 49/340 |
| 6,938,372 | B1 * | 9/2005 | Kennedy et al. | 49/138 |
| 2003/0079423 | A1 | 5/2003 | Kennedy et al. | |

OTHER PUBLICATIONS

Jack Kennedy Metal Products & Buildings, Inc., Form Transmittal Letter for Kennedy Power Machine Doors, Jul. 2, 2002.

The American Mine Door Company, Canton Doors. . . for Trucks. . . for Motors. . . Speed up haulage brochure, admitted prior art.

* cited by examiner

CONTROL SYSTEM FOR PNEUMATICALLY-POWERED DOOR INSTALLATION

CROSS REFERENCE TO RELATED APPLICATION

This is a divisional application based on U.S. application Ser. No. 10/608,900 filed Jun. 27, 2003, now U.S. Pat. No. 6,938,372.

FIELD OF INVENTION

The present invention relates to a mine door installation and more particularly to a control system for a pneumatically-powered mine door installation.

BACKGROUND

Doors used in mines operate under conditions not usually encountered by typical doors. Mine doors have door leafs that tend to be heavy and dimensionally large and are thus subject to large forces due at least in part to ventilation air flow in the mine and consequent air pressure differentials on opposite sides of a door. A leaf can be as large as 10 feet wide and 20 feet high and sometimes even larger. It can weigh more than a thousand pounds when designed for pressure differentials of seven inches of water gauge and over two thousand pounds for a pressure differential of 20 inches of water gauge. Even small pressure differentials can create large forces on the leafs because of their relatively large surface areas. It is difficult to control door leaf movement because of these forces and because of the substantial inertia associated with the heavy door leafs. Thus, it is desirable for the opening and closing of mine doors to be powered by one or more actuators, such as pneumatic or hydraulic power cylinders. From a cost standpoint, pneumatic power cylinders are preferred over hydraulic power cylinders. It is also desirable to use pneumatic power rather than hydraulic power because compressed air that may already be available in relation to other mine operations can be used to power the door installation as well, thereby obviating the need to provide a separate power supply for the door installation.

Unfortunately, pneumatically-powered mine doors are vulnerable to door leaf runaway due to compressibility of the air in the pneumatic actuator. When the resistance to door movement is high, the pressure in the pneumatic actuator must build up sufficiently to overcome the resistance. If the resistance drops off while the pressure in the pneumatic actuator is still high, the door leaf can accelerate unexpectedly and swing with great speed. This is dangerous because a rapidly swinging door leaf could easily injure a person or damage machinery. At a minimum a runaway door leaf would cause undesirable wear or damage to the door installation. Furthermore, the mine environment creates conditions that favor door leaf runaway. For example, if the door leaf opens by swinging toward the high pressure side of the door, the initial resistance to opening the door will be much higher than the resistance after the door is opened a small amount and the air pressures on opposite sides of the door leaf begin to equalize. It is also possible that a door leaf will catch on part of the floor or ceiling due to the natural convergence of the floor and ceiling caused by the overburden. Similarly, rock or other debris could obstruct movement of a door leaf. As a result of these or similar obstructions, pressure could build up in the pneumatic actuator causing the door leaf to run away when the resistance drops after the leaf has overcome the obstruction.

One strategy that has been employed to partially obviate the problem with runaway door leafs is to arrange the door so the leafs open by swinging away from the high pressure side of the door. Alternatively, a bi-directional double door can be used wherein one leaf opens by swinging away from the high pressure and one leaf opens by swinging toward the high pressure. If at least one door leaf opens by swinging away from the high pressure side of the door installation, the pneumatic actuator does not need to build up as much pressure to initiate opening. Consequently, the runaway leaf problem is alleviated to some degree. However, this is not an entirely satisfactory resolution to the runaway leaf problem. The leafs are still susceptible to runaway caused by obstructions from the floor, ceiling, or debris. Moreover, the door installation does not seal well when there is a leaf that opens by swinging away from the high pressure side of the door because the force from the pressure differential tends to move the leaf toward the open position and tends to push any sealing flaps away from the surfaces against which they are intended to seal. A better seal can be obtained by having all the door leafs in a door installation open by swinging toward the high pressure side. This way the force from the pressure differential tends to tighten the seal by pressing the door leafs and sealing flaps tightly closed.

Thus, there is a need for a mine door installation powered by pneumatic cylinders that avoids the problem noted above.

SUMMARY OF INVENTION

An embodiment of the present invention is a pneumatically controlled mine door installation. The mine door installation has a frame installed in a mine passageway. At least one door leaf is mounted on the frame for swinging movement between open and closed positions. The door leaf has a first face that is subject to relatively higher air pressure and a second face that is subject to relatively lower air pressure when the door installation is closed. An extensible and retractable pneumatically-powered actuator is mounted with a first end connected to the door leaf and a second end connected to a pneumatic actuator anchor so that extension and retraction of the actuator causes the door leaf to swing back and forth between its open and closed positions. The door installation also has a hydraulic checking system for controlling the speed of the door leaf as it moves back and forth between open and closed positions.

Another embodiment of a pneumatically-powered mine door installation for operation in a mine with an air ventilation system comprises a mine door frame installed in a mine passageway. First and second door leafs are mounted on opposite sides of the mine door frame for swinging movement between open and closed positions. Each door leaf has a first face that is subject to relatively higher air pressure and a second face that is subject to relatively lower air pressure when the first and second door leafs are in their closed positions. Each door leaf also has an extensible and retractable pneumatically-powered actuator mounted with a first end connected to the respective door leaf and a second end connected to a pneumatic actuator anchor so that extension and retraction of the actuator causes the respective door leaf to swing back and forth between its open and closed positions. The door installation also has a hydraulic checking system for controlling the speed of the first and second door leafs as they swing back and forth between their open and closed positions.

A control system for operating a pneumatically-powered door installation according to the present invention comprises a moveable control valve for selectively supplying air power to one or more actuators to cause swinging movement of one or more door leafs in a door installation in a mine passageway. The moveable control valve is biased toward a first position in which air power is not supplied to the one or more pneumatic actuators and moveable to a second position in which air power is supplied to the one or more pneumatic actuators. A second valve is operable to selectively open and close an air supply line between the control valve and a source of compressed air. The control valve is moved to its second position by the compressed air when the air supply line is open. The control system further comprises a calibrated vent for venting the air supply line between the control valve and the second valve.

Another embodiment of a control system for operating a pneumatically-powered mine door installation according to the present invention comprises a moveable control valve for selectively supplying air power to one or more actuators to open one or more door leafs in a door installation. The control system also comprises one or more operating valves operable to open and close an air supply line between the control valve and a source of compressed air. When the air supply line is open, the control valve is moved to a position supplying air power to said one or more actuators to open the one or more door leafs. The control system further comprises a limit valve which is also operable to open and close said air supply line between the control valve and the source of compressed air. The limit valve is operably linked to a second door installation whereby the air supply line is closed when the second door installation is open.

Other advantages and features of the present invention will be in part apparent and in part pointed out hereinafter.

BRIEF DESCRIPTION OF THE DRAWINGS

Corresponding parts have corresponding reference characters throughout the drawings.

DETAILED DESCRIPTION

The technology of the present invention can be applied to both single-leaf door installations and double-leaf door installations. After the construction and operation of a single-leaf door installation has been described, a detailed description of the construction and operation of a double-leaf door installation of the present invention will be provided. A detailed description of control systems that are particularly suited for operation of door installations of the present invention will also be provided.

Single-Leaf Door Installation

Figure 1:
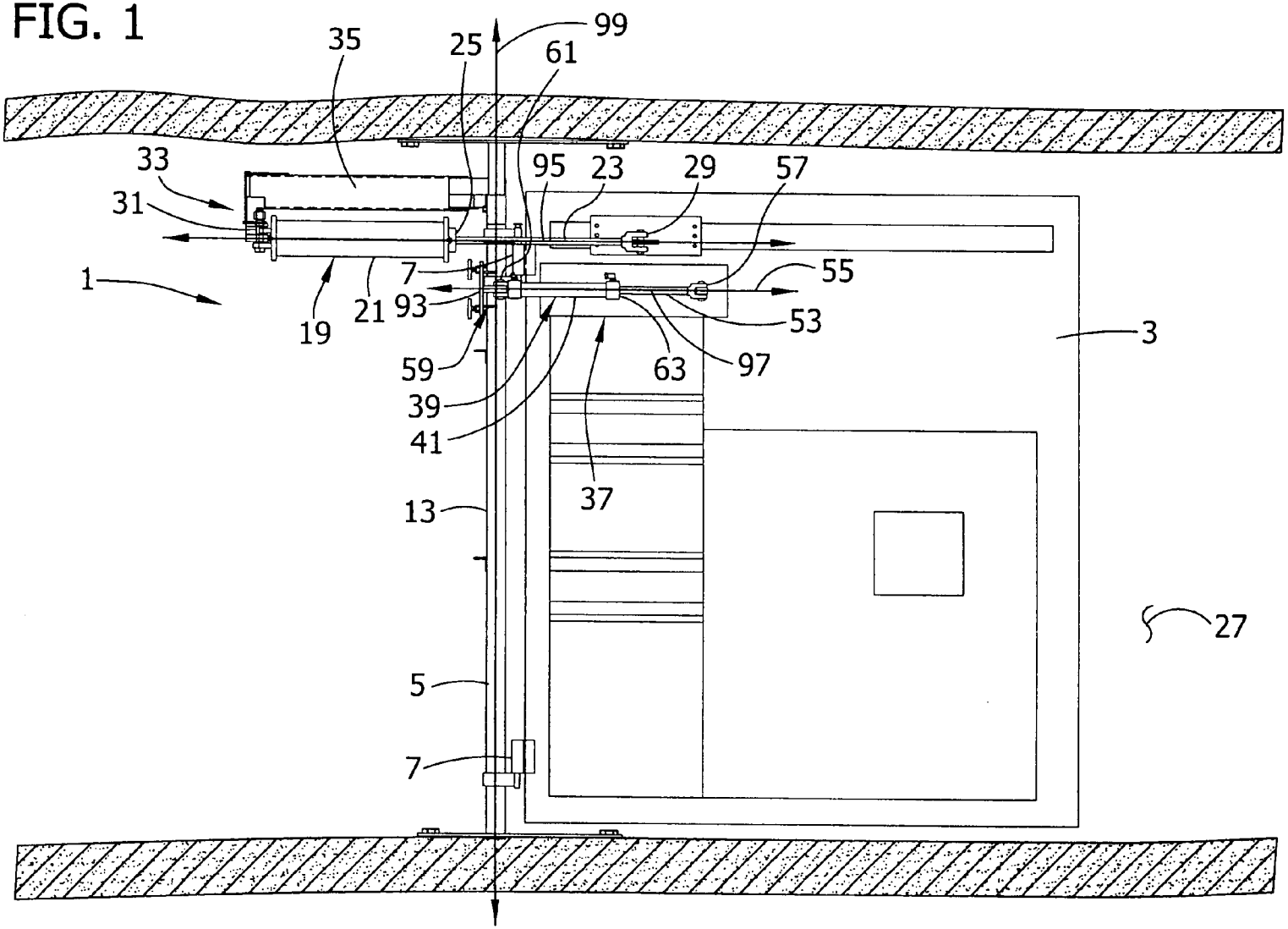
FIG. 1 is a side elevation of a single-leaf door installation of the present invention, with the door leaf being shown in its open position.
Figure 2:
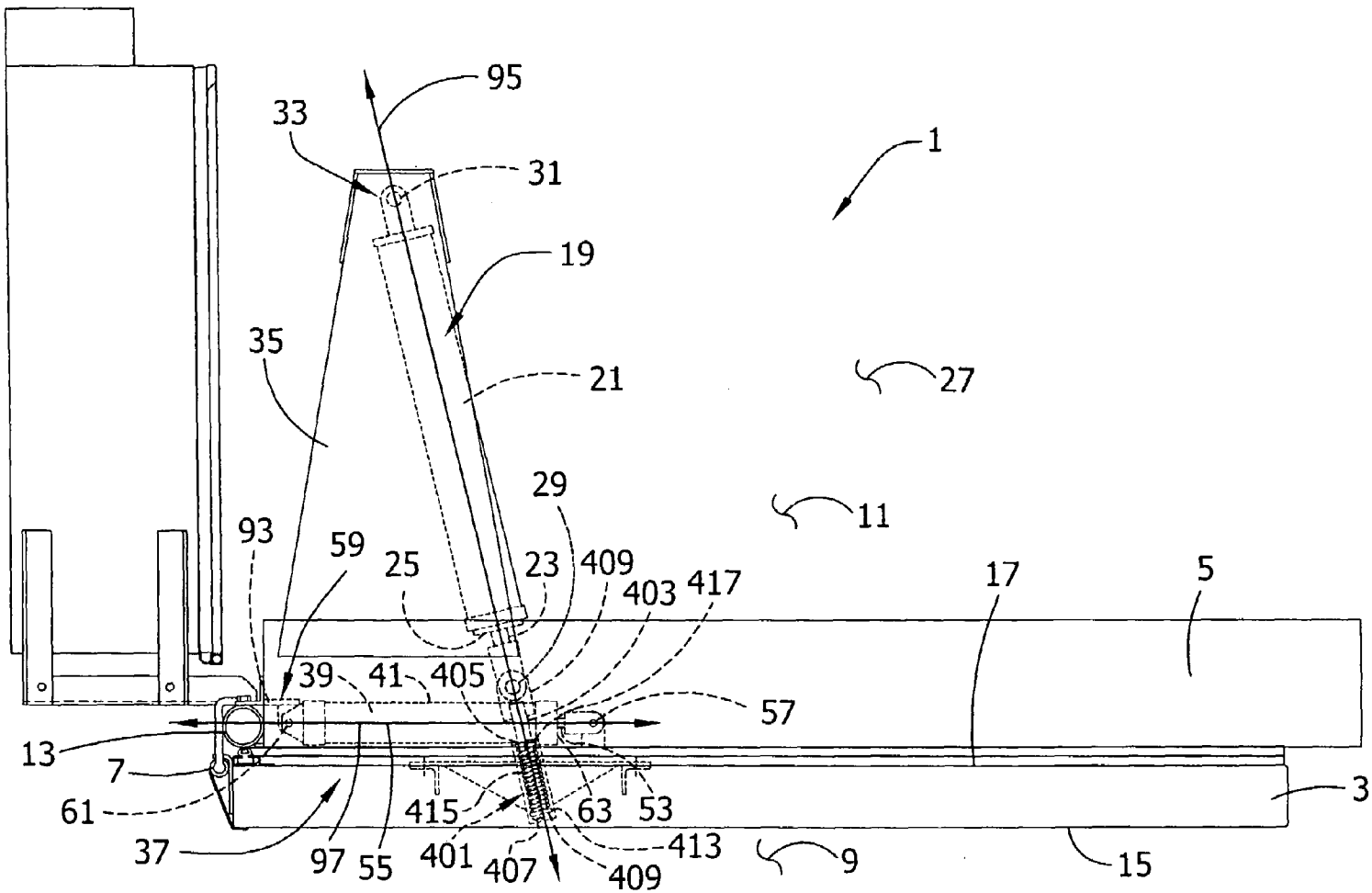
FIG. 2 is an enlarged top plan view of the door installation of FIG. 1 with the door leaf being shown in its closed position.
Figure 3:
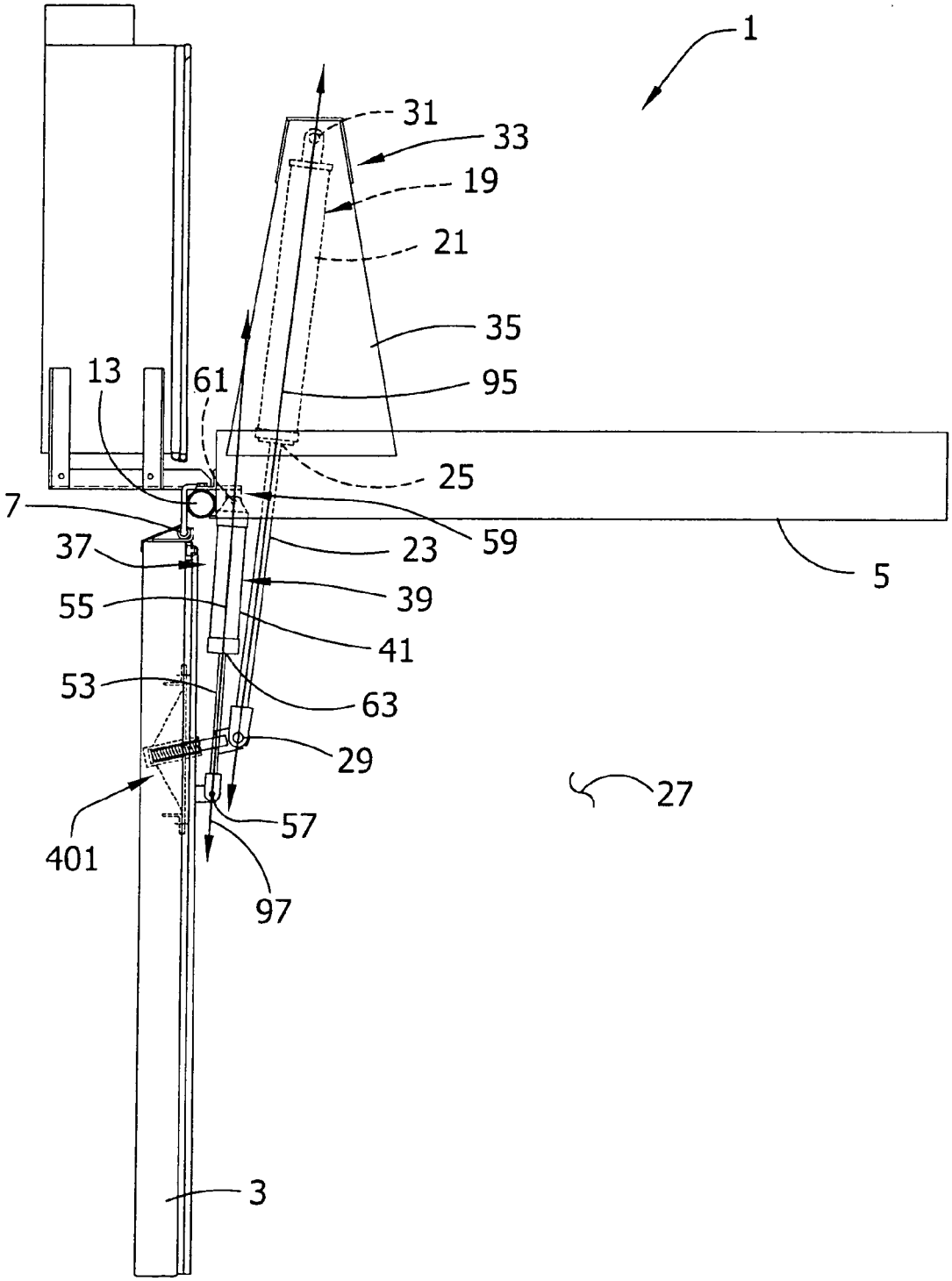
FIG. 3 is an enlarged top plan view of the door installation of FIGS. 1 and 2 with the door leaf being shown in its open position.

An exemplary single-leaf door installation of the present invention, generally designated 1, is shown in FIGS. 1–3. The door installation comprises a door frame 5 installed in a mine passageway 27. A door leaf 3 is mounted on a column 13 of the door frame 5, by one or more hinges 7 for example, for back and forth swinging movement of the door leaf 3 between a closed position (FIG. 2) and an open position (FIG. 3). Details on mine door frame construction as well as other aspects of mine door usage are provided in U.S. Pat. No. 4,911,577 (Mine Door System); U.S. Pat. No. Re. 34,053 (Mine Door System); U.S. Pat. No. 5,168,667 (Door System for Mine Stopping); U.S. Pat. No. 5,222,838 (Power Mine Door System); U.S. Pat. No. 5,240,349 (Power Mine Door System); U.S. Pat. No. 6,032,986 (Door System for Mine Stopping); U.S. Pat. No. Re. 36,853 (Mine Door System); U.S. Pat. No. 6,164,871 (Mine Stopping Having a Swinging Door) and U.S. Pat. No. 6,425,820 (Mine Door Power Drive System), all of which are assigned to Jack Kennedy Metal Products, Inc. of Taylorville, Ill., all of which are hereby incorporated herein by reference.

When the door leaf 3 is in its closed position the entire perimeter of the door leaf 3 is adjacent the door frame 5, thereby forming an obstruction to airflow through the mine passageway 27. One or more conventional sealing flaps (not shown) may be provided along the perimeter of the door leaf 3 to further restrict airflow through the door installation 1. Due to operation of the mine ventilation system (not shown), one side 9 of the door installation 1 is typically subjected to a relatively higher air pressure than the other side 11 of the door installation 1. Because the high pressure face 15 of the door leaf 3 is under more pressure that the low pressure face 17, a net force is exerted on the door leaf 3. Even a modest pressure differential can generate a large force because of the large surface area of the door leafs 3. In the embodiment shown in FIGS. 1–3, the door installation 1 is installed so the door leaf 3 opens by swinging toward the side subjected to the relatively higher air pressure 9. Although it is often preferable to install the door installation 1 as shown in FIGS. 1–3 so the door seals better as discussed in the background section above, one could install a door 1 that opens by swinging away from the side that is subjected to the relatively higher air pressure 9 without deviating from the scope of this invention.

The door installation 1 comprises an extensible and retractable pneumatically-powered actuator 19 for providing powered opening and closing of the door leaf 3. In the embodiment shown in FIGS. 1–3, the pneumatic actuator 19 comprises a conventional double-acting pneumatic power cylinder having a pneumatic housing 21 at one end and an extensible and retractable rod 23 extending through an opening 25 in the housing 21 to form the other end. One preferred pneumatic power cylinder is commercially available as model number JK19226 from Jack Kennedy Metal Products and Buildings, Inc. of Taylorville, Ill. One with ordinary skill in the art could readily identify other suitable pneumatic power cylinders. Those with ordinary skill in the art will also understand that pneumatic cylinders are a very common type of pneumatic actuator, but that the cylindrical shape is not essential to operation of the actuator. Thus, terms pneumatic cylinder and pneumatic actuator as used in this specification are intended to encompass any pneumatic device that operates in substantially the same way as the pneumatic power cylinder shown in FIGS. 1–3, whether it has a cylindrical shape or not.

As is well known, compressed air can be used to drive extension or retraction of the rod 23 of the pneumatic power cylinder 19. The pneumatic cylinder 19 may be connected to the door leaf 3 so that extension of the rod 23 causes swinging movement of the door leaf 3 toward its open position and retraction of the rod 23 causes swinging movement of the door leaf 3 toward its closed position. For example, as shown in FIGS. 1–3, the end of the rod 23 of the pneumatic cylinder 19 may be pivotally connected to the door leaf by means of a clevis connection 29, and the housing 21 of the pneumatic actuator 19 may be pivotally connected to a pneumatic cylinder anchor 33 by a pin connection 31. The pneumatic cylinder anchor 33 may be a substantially rigid bracket 35 extending from the door frame 5 as shown in FIGS. 1–3, for example, or it may be any other substantially immovable device for mounting the pneumatic cylinder 19. Those having ordinary skill in the art will recognize that a bell crank could be used to reverse the action of the pneumatic power cylinder 19, so that extension of the cylinder 19 causes swinging movement of the door leaf 3 toward its closed position for example, without departing from the scope of this invention. A control system is provided to selectively control extension and retraction of the pneumatic rod, thereby selectively controlling opening and closing of the door leaf in a manner described in more detail below. Any conventional control system may be used for the single-leaf embodiments, however, as discussed in more detail below, the control system may be designed to provided certain features that may be advantageous in a mine environment.

As shown in FIG. 2, the door leaf 3 may be equipped with a spring dampening system 401 to absorb any shock of the door leaf 3 closing against the door frame 5 and to accommodate movement of the door frame 5 that may be caused by the overburden. The spring dampening system 401 may comprise a substantially rigid bar 403 having one end 411 that is shaped to form part of the clevis connection 29 and a free end 409 that extends through an opening 405 in the door leaf 3 into a cavity 407 in the door leaf 3. The free end 409 of the bar 403 has flange 413. A spring 415 is disposed between the flange 413 and an end wall 417 of the cavity 407 so that movement of the free end 409 of the bar 403 toward the opening 405 results in compression of the spring 415. Thus, continued retraction of the rod 23 of the pneumatic actuator 19 after the door leaf 3 has reached its closed position or after closing movement of the door leaf 3 has been obstructed, by debris for example, will result in the free end 409 of the bar 403 being pulled toward the opening 405, which will compress the spring 415 and absorb any shock to the door installation 1. Furthermore, as the spring 415 compresses after the door leaf 3 has reached its closed position, the force with which the door leaf 3 is held closed increases gradually so the door leaf 3 does not slam shut. The spring dampening system 401 makes the door installation 1 more tolerant to movement of the door frame 5 because the stroke of the pneumatic actuator 19 does not need to be adjusted to accommodate small movements of the door frame 5, which will only change the amount by which the spring 415 is compressed when the pneumatic actuator 19 reaches the end of its closing stroke.

A hydraulic checking system 37 is used to control movement of the door leaf. In one embodiment, the hydraulic checking system 37 comprises a double-acting hydraulic checking cylinder 39. One preferred hydraulic checking cylinder 39 is commercially available as model number JK21487 from Jack Kennedy Metal Products and Buildings, Inc. of Taylorville, Ill. One with ordinary skill in the art could identify other suitable hydraulic checking cylinders for use in the hydraulic checking system. Those familiar with hydraulic systems will understand that the hydraulic cylinder is a very common form of hydraulic device, but that the cylindrical shape is not essential to operation of the device. Thus, the term hydraulic checking cylinder is intended to include any hydraulic device that operates in substantially the same way as the hydraulic checking cylinder in FIGS. 1–3, whether the device has a cylindrical shape or not.

Figure 4:
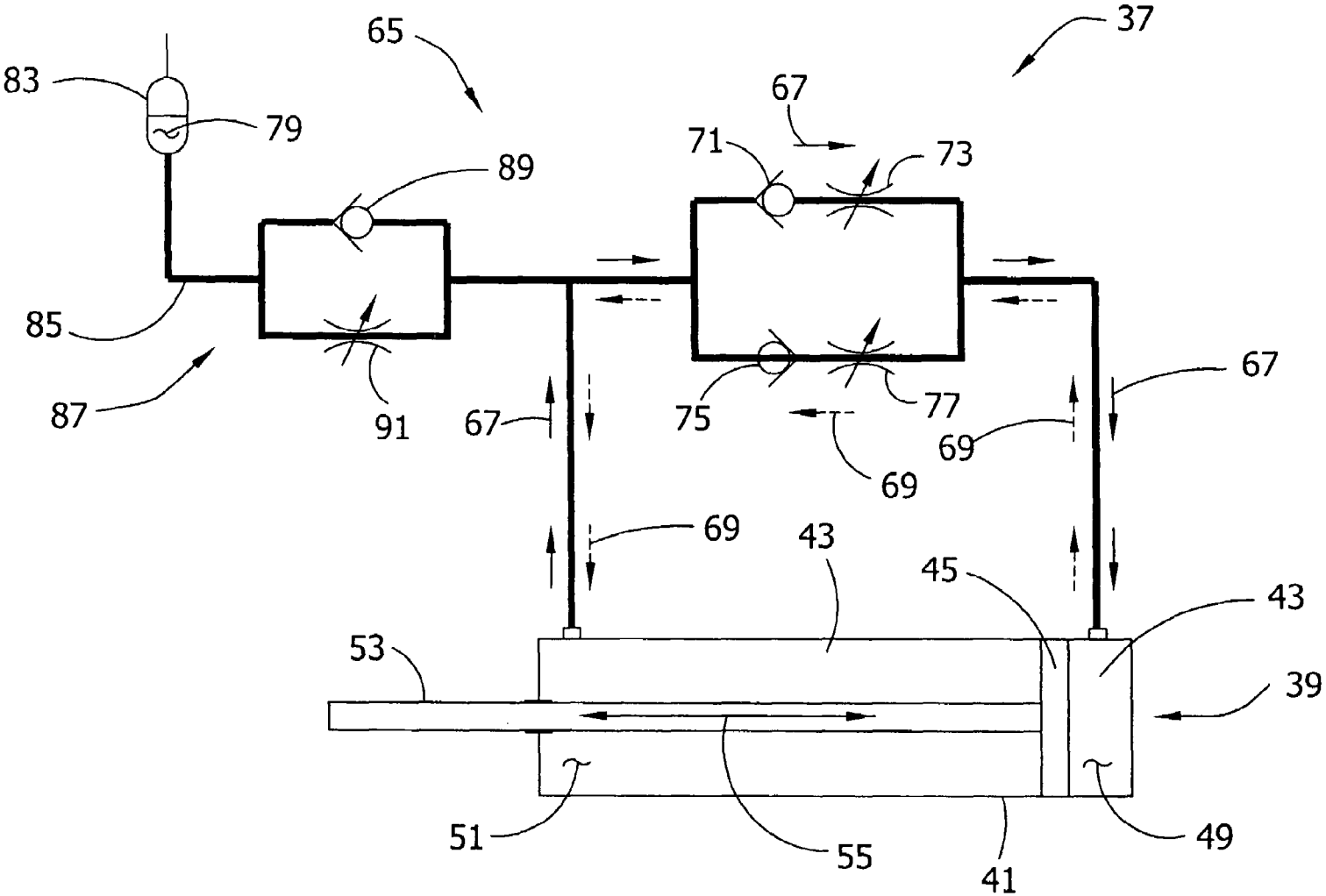
FIG. 4 is a schematic diagram of one hydraulic circuit that is suitable for use with the single-leaf door installation.

A suitable hydraulic checking cylinder comprises a housing 41 containing hydraulic fluid 43, as depicted schematically in FIG. 4. A piston 45 inside the housing 41 is connected to a rod 53 that extends through an opening 63 from the interior of the housing 41 to the exterior. The piston 45 separates the interior of the housing 41 into a blind end fluid chamber 49 filled with a first volume of hydraulic fluid 43 and a rod end fluid chamber 51 filled with a second volume of hydraulic fluid 43. The piston 45 and rod 53 are slidable along a sliding axis 55 of the housing 41, thereby allowing the rod 53 to extend and retract relative to the housing 41. Fluid-tight packing seals (not shown) or the like are provided to prevent hydraulic fluid 43 from leaking out of the opening 63 in the housing 41 through which the rod 53 extends. Piston rings or the like (not shown) create a fluid-tight sliding seal between the piston 45 and the housing 41, preventing hydraulic fluid 43 from flowing around the piston 45 to move back and forth between the two fluid chambers 49, 51. The hydraulic checking cylinder 39 may be connected to the door leaf 3 so that swinging movement of the door leaf 3 requires extension or retraction of the rod 53 with respect to the housing 41. As shown in FIGS. 1–3, for example, the end of the rod 53 may be pivotally connected to the door leaf 3 by a clevis connection 57, and the housing 41 may be pivotally connected to a hydraulic checking system anchor 59 at a pin connection 61. Thus, in the embodiment shown in FIGS. 1–3 swinging movement of the door leaf 3 toward its open position requires extension of the rod 53. Those having ordinary skill in the art will recognize that a bell crank could be used to reverse the action of the hydraulic checking cylinder 39, so that swinging movement of the door leaf toward its open position requires retraction of the rod 53.

A hydraulic circuit provides fluid connection between the blind end fluid chamber 49 and the rod end fluid chamber 51. The hydraulic circuit has at least one flow restriction that limits the flow of hydraulic fluid through the hydraulic circuit. For example, a flow restriction may comprise an adjustable needle valve. Those having ordinary skill in the art will recognize that ball valves, globe valves, gate valves, spool valves, and many other types of valves could be used for the flow restriction without departing from the scope of this invention. One exemplary hydraulic circuit 65 suitable for use in a single-leaf door installation 1 of the present invention is shown schematically in FIG. 4. Two fluid pathways 67, 69 provide fluid connection between the two fluid chambers 49, 51. The first fluid pathway 67, indicated by the solid-tailed arrows in FIG. 4, allows fluid to flow from the rod end fluid chamber 51 to the blind end fluid chamber 49. A check valve 71 in the first fluid pathway 67 prevents hydraulic fluid 43 from flowing from the blind end fluid chamber 49 to the rod end fluid chamber 51 through the first fluid pathway 67. An adjustable needle valve 73 in the first fluid pathway 67 limits the flow from the rod end fluid chamber 51 to the blind end fluid chamber 49. The second fluid pathway 69, indicated by the dashed-tailed arrows in FIG. 4, allows fluid 43 to flow from the blind end fluid chamber 49 to the rod end fluid chamber 51. A check valve 75 in the second fluid pathway 69 prevents fluid 43 from flowing from the rod end fluid chamber 51 to the blind end fluid chamber 49 through the second fluid pathway 69. An adjustable needle valve 77 is provided in the second fluid pathway 69 to limit flow from the blind end fluid chamber 49 to the rod end fluid chamber 51.

For reasons that will become clear after operation of the door installation 1 is described below, the hydraulic checking circuit 65 of FIG. 4 also comprises a pressurized hydraulic fluid reservoir 79. The pressurized reservoir 79 may be contained in a pressure vessel 83, such as hydraulic pressure vessel model number JK19258 from Jack Kennedy Metal Products and Buildings, Inc. of Taylorville, Ill. The hydraulic fluid reservoir 79 may be pressurized by any suitable means. However, it is contemplated that one could pressurize the hydraulic fluid reservoir 79 with the same source of compressed air used to operate the pneumatic actuator 19 thereby obviating the need for a separate power source. A reservoir connecting line 85 provides fluid connection between the pressurized reservoir 79 and the rod end fluid chamber 51. A flow control valve 87 in the reservoir connecting line 85 comprises a check valve 89 and an adjustable needle valve 91 plumbed in parallel. The check valve 89 allows free flow of hydraulic fluid 43 from the pressurized hydraulic fluid reservoir 79 to the rod end fluid chamber 51. However, flow from any part of the hydraulic circuit 65 to the pressurized reservoir 79 is limited by the adjustable needle valve 91.

Operation of Single-Leaf Door Installation

Because mine door installations are normally kept closed (as shown in FIG. 2), the basic operation of the door installation 1 begins when the control system is triggered to direct extension of the pneumatic actuator 19. Extension of the pneumatic actuator 19 causes the door leaf 3 to swing toward its open position (shown in FIGS. 1 and 3), which requires extension of the rod 53 in the hydraulic checking cylinder 39. This, in turn requires the piston 45 and rod 53 to slide within the housing along the sliding axis 55, thereby changing the volumes of the two fluid chambers 49, 51. To accommodate the changing volumes in the two fluid chambers 49, 51, hydraulic fluid 43 must flow through the flow restriction in the hydraulic circuit. Similarly, when the control system is triggered to direct retraction of the pneumatic actuator 19, the door leaf 3 swings closed which causes the rod 53 in the hydraulic checking cylinder 39 to retract. This also requires hydraulic fluid 43 to flow through the flow restriction to accommodate the changing volumes of the two fluid chambers 49, 51. Because the flow of hydraulic fluid 43 through the hydraulic circuit is limited by the flow restriction, the rate of extension and retraction of the rod 53 in the hydraulic checking cylinder 39 is also limited. Accordingly, the hydraulic checking system 37 prevents the door leaf 3 from swinging too rapidly notwithstanding any drop off in the external resistance to movement of the door leaf 3.

In the hydraulic checking circuit 65 shown in FIG. 4, for example, when the rod 53 in the hydraulic checking cylinder 39 is extending as the door leaf 3 swings toward the open position, hydraulic fluid 43 must exit the decreasing volume of the rod end fluid chamber 51 and flow through the first fluid pathway 67 to fill the increasing volume of the blind end fluid chamber 49. The adjustable needle valve 73 in the first fluid pathway 67 limits the hydraulic fluid 43 flow rate during opening. Consequently, the rate of extension of the rod 53 and therefore the rate at which the door leaf 3 can open are also limited. By adjusting the needle valve 73 in the first fluid pathway 67 to increase or decrease the flow rate, one can increase or decrease the opening speed of the door leaf 3. Likewise, when the rod 53 retracts as the door leaf 3 swings toward the closed position, hydraulic fluid 43 must exit the blind end fluid chamber 49 and flow through the second fluid pathway 69 to fill the rod end fluid chamber 51. Thus, the adjustable needle valve 77 in the second fluid pathway 69 limits the hydraulic fluid flow rate during closing, thereby limiting the speed at which the door leaf 3 closes. One can increase or decrease the closing speed of the door leaf 3 by adjusting the needle valve 77 in the second fluid pathway 69.

The total volume of hydraulic fluid filling the interior of the housing 41 varies as the rod 53 extends and retracts because as the rod 53 retracts it occupies more volume in the housing 41. A reservoir is required to hold at least the volume of hydraulic fluid 43 displaced by the rod 53 when it is fully retracted. For example in the hydraulic checking circuit 65 shown schematically in FIG. 4, a pressurized reservoir 79 is provided to receive the volume of hydraulic fluid 43 expelled from the housing 41 when the rod 53 is fully retracted. As the rod 53 extends, the check valve 89 in the reservoir connecting line 85 opens to allow hydraulic fluid 43 to flow from the pressurized reservoir 79 to the rod end fluid chamber 51 to fill the volume vacated by the extending rod 53. Conversely, when the rod 53 retracts an amount of fluid 43 corresponding to the displacement of the rod 53 flows to the pressurized reservoir 79. Because the check valve 89 will not allow flow in this direction, the adjustable needle valve 91 in the reservoir connecting line 85 limits the flow in this direction. If unlimited flow were permitted through the reservoir connecting line 85 in this direction, hydraulic fluid 43 in the rod end fluid chamber 51 would simply flow to the pressurized reservoir 79 upon extension of the rod 53 rather than flow through the second fluid pathway 69 to the blind end fluid chamber 49. Thus, the setting for the adjustable needle valve 91 in the reservoir connecting line 85 is preferably adjusted to be slightly more restrictive than the setting for the adjustable needle valve 77 in the second fluid pathway 69.

The pressurized hydraulic fluid reservoir 79 performs another important function. Conventional rod seal packings (not shown) used in hydraulic cylinders are directional seals designed to prevent hydraulic fluid from leaking out of the housing when there is a high internal pressure. The seals are not suitable for keeping air from leaking into the hydraulic cylinder when there is negative internal pressure, such as might occur in the rod end fluid chamber 51 when the rod 53 is forced to retract into the housing 41. Failure to address this problem makes the hydraulic checking system 37 susceptible to entrainment of air and other contaminants which would interfere with proper functioning of the hydraulic checking cylinder 39. The hydraulic fluid reservoir 79 of the checking circuit 65 shown in FIG. 4 has been pressurized to solve this problem. If the pressure in the rod end fluid chamber 51 drops below the pressure in the pressurized hydraulic fluid reservoir 79, the check valve 89 in the reservoir connecting line 85 opens to allow hydraulic fluid 43 to flow into the rod end fluid chamber 51 to equalize the pressures in the rod end fluid chamber 51 and the pressurized hydraulic reservoir 79. Thus, the pressure in the rod end fluid chamber 51 is maintained above ambient air pressure.

Mounting Alternatives

Depending on the specific objectives of the particular door installation, it may be advantageous to vary the locations at which the pneumatic actuator 19 and the hydraulic checking cylinder 39 are connected to the door leaf 3 and to vary the locations of the respective anchors 33, 59 for the pneumatic actuator 19 and the hydraulic checking cylinder 39. Both the pneumatic actuator 19 and the hydraulic checking cylinder 39 operate by applying a force to the door leaf 3. The pneumatic actuator 19 provides a driving force that acts along a line of action 95 between the connections 29, 31 of the pneumatic actuator 19 to the door leaf 3 and to the pneumatic cylinder anchor 33. The hydraulic checking cylinder 39 provides a checking force which acts along a line of action 97 between the connections 57, 61 of the hydraulic checking cylinder 39 to the door leaf 3 and to the hydraulic checking cylinder anchor 59. As the door leaf 3 moves back and forth between its open and closed positions, the angles between the lines of action 95, 97 for the forces and the plane of the door leaf 3 will vary. This will affect the mechanical advantage of the pneumatic actuator 19 and hydraulic checking cylinder 39. The rate of extension or retraction of the pneumatic actuator 19 and the hydraulic checking cylinder 39 as a function of the angular velocity of the door leaf 3 will vary depending on the angular position of the door leaf 3. By selecting appropriate locations for the anchors 33, 59 and connections 29, 57 to the door leaf 3, one can optimize the power of the pneumatic actuator 19 when it is most needed or optimize the checking action of the hydraulic checking system 37 when it is most needed.

For example, in the exemplary embodiment shown in FIG. 1–3, the pneumatic actuator 19 is roughly perpendicular to the door leaf 3 when the door leaf 3 is in the closed position. Consequently, the pneumatic actuator 19 operates with relatively high leverage as it begins opening the door leaf 3 against the force due to the pressure differential, which is typically the largest load for the pneumatic actuator. This has the desirable effect of reducing the maximum operating pressure of the pneumatic actuator 19. As the door leaf 3 swings open, the line of action 95 of the pneumatic actuator 19 changes, decreasing the leverage of the pneumatic actuator. However, the loss of leverage is associated with an increase in the operating speed of the door leaf 3 because the ratio of the rate of extension of the pneumatic actuator 19 to the angular velocity of the door leaf 3 decreases as the door leaf 3 moves further toward its open position. Because the increased operating speed is often desirable and the extra power required to overcome the force from the pressure differential is not needed once the pressures on opposite sides 15, 17 of the door leaf 3 equalize, the mounting configuration for the pneumatic actuator 19 shown in FIGS. 1–3 works well. Of course, those skilled in the art will recognize that the increase in operating speed described above requires only the ratio of the rate of extension of the pneumatic actuator 19 to the angular velocity of the door leaf 3 decrease as the door leaf 3 moves along a substantial portion of the path from its closed to its open position. For example, one could design a configuration in which the ratio of the rate of extension of the pneumatic actuator 19 to the angular velocity of the door leaf 3 increases as the door leaf 3 moves further toward its open position along initial or terminal portions of the path of the door leaf 3 from the closed position to the open position without deviating from the scope of this invention.

In contrast, in the embodiment shown FIGS. 1–3, the hydraulic checking cylinder 39 is anchored by a bracket 93 welded to a column 13 at one side of the door frame 5, which is close to the vertical pivot axis 99 of the door leaf 3. Thus, when the door leaf 3 is in its closed position the line of action 97 for the hydraulic checking cylinder 39 is substantially parallel to the door leaf 3. Accordingly, when the door leaf 3 begins its initial movement from its closed position the hydraulic checking cylinder 39 has a very little leverage. Furthermore, the ratio of extension of the rod 53 to the angular velocity of the door leaf 3 is relatively low when the door leaf 3 is closed or nearly closed. Thus, at this point in the door's operation, the hydraulic checking system 37 adds minimal resistance to the already heavy load of the force from the pressure differential. However, as the door leaf 3 moves farther toward the open position, the ratio of the rate of extension of the rod 53 to the angular velocity of the door leaf 3 increases and the line of action 97 of the hydraulic checking cylinder 39 changes to provide better leverage. Accordingly, after the pneumatic actuator 19 has overcome the force from the pressure differential, the hydraulic checking system plays 37 a more prominent role. Again, one skilled in the art would recognize that the ratio of the rate of extension of the rod 53 to the angular velocity of the door leaf 3 may decrease along the initial or terminal potions of the path of the door leaf 3 from its closed position to its open position without deviated from the scope of this invention as long as the ratio increases along a substantial portion of the door leaf's 3 path from the closed position to the open position.

An additional advantage of anchoring the hydraulic checking cylinder 39 to the column 13 on the side of the door frame 5 is that there is no need to construct a separate linkage to anchor the hydraulic checking cylinder 39, which cuts the manufacturing expense. It is also advantageous to design the door installation 1 so that the hydraulic checking cylinder 29 has a shorter operating stroke than the pneumatic actuator 19. As the stroke of the hydraulic checking cylinder 39 becomes longer, the columnar stresses on the rod 53 increase. To account for the increased columnar stresses a disproportionately heavy and more expensive hydraulic checking cylinder is required. Shorter strokes do increase the operating pressure in the hydraulic checking system 37. However, hydraulic systems can tolerate much higher operating pressures than pneumatic systems so having the stroke for the hydraulic checking cylinder 39 shorter than the stroke of the pneumatic actuator 19 is acceptable. In the embodiment shown in FIGS. 1–3, for example, the hydraulic checking cylinder 39 has a relatively short stroke because the anchor 59 is close to the vertical pivot axis 99 of the door leaf 3.

Figure 5:
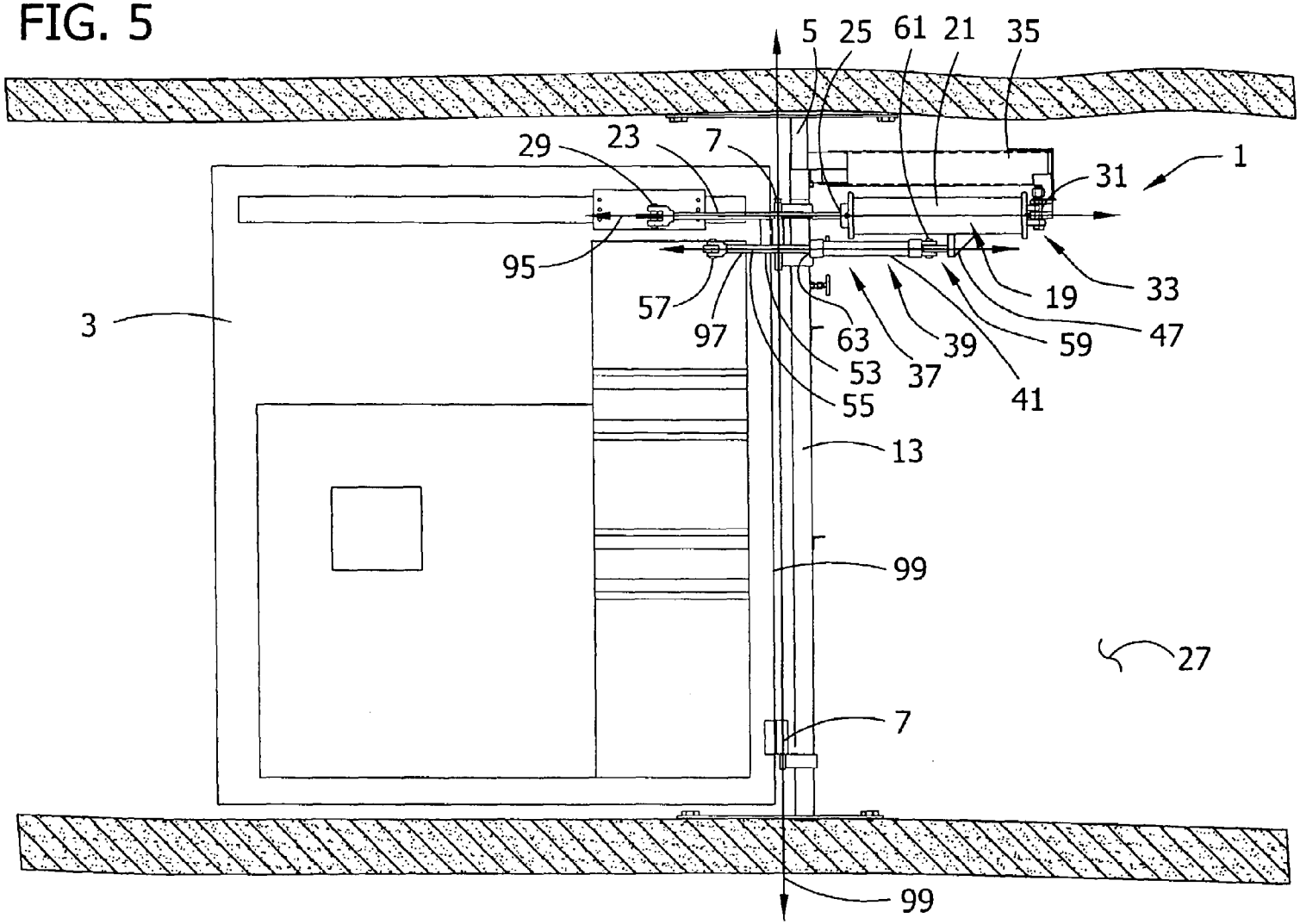
FIG. 5 is a side elevation of an alternative embodiment of a single-leaf door installation of the present invention.
Figure 6:
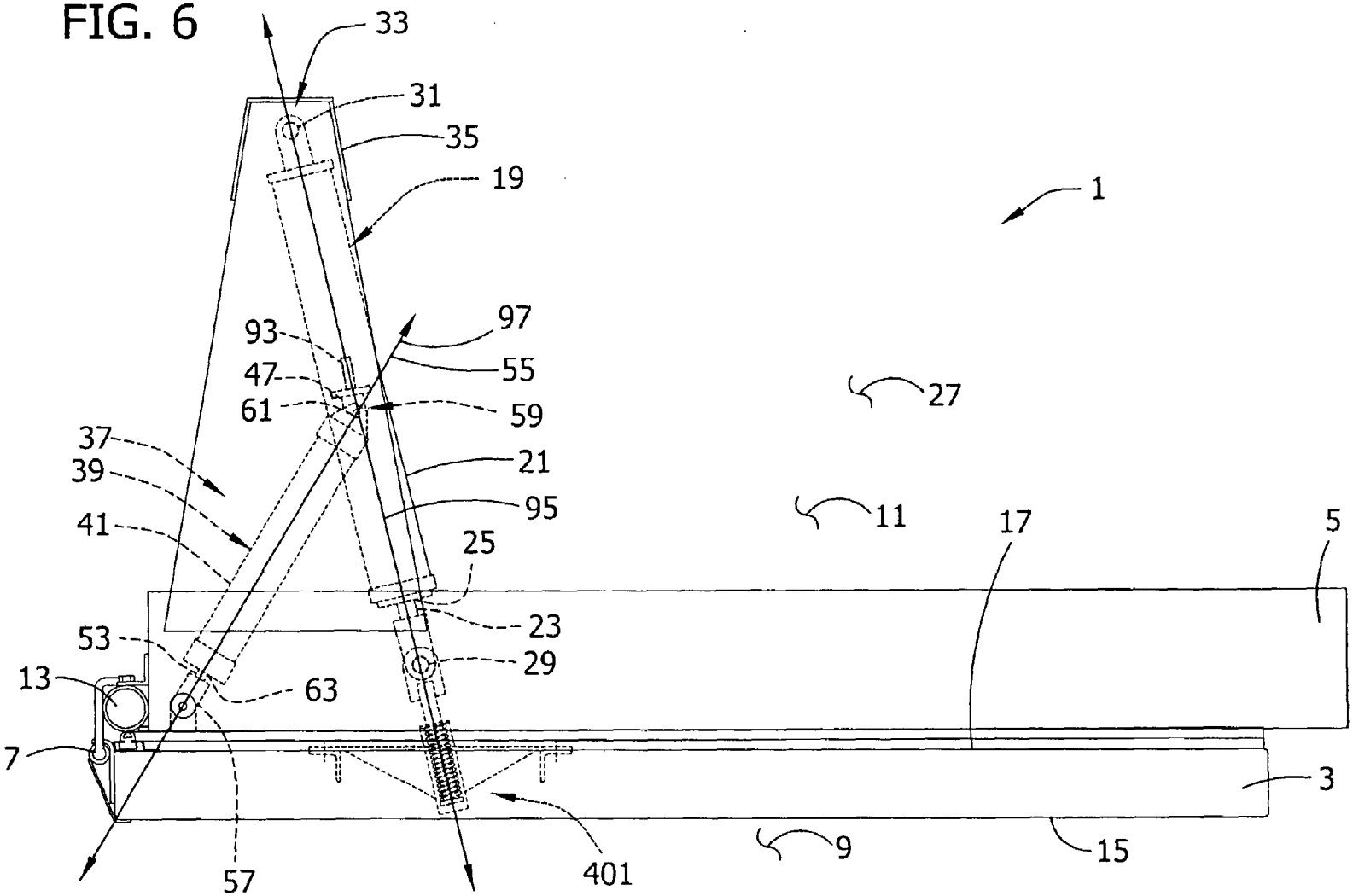
FIG. 6 is a top plan view of the single-leaf door installation of FIG. 5 with the leaf being shown in its closed position.
Figure 7:
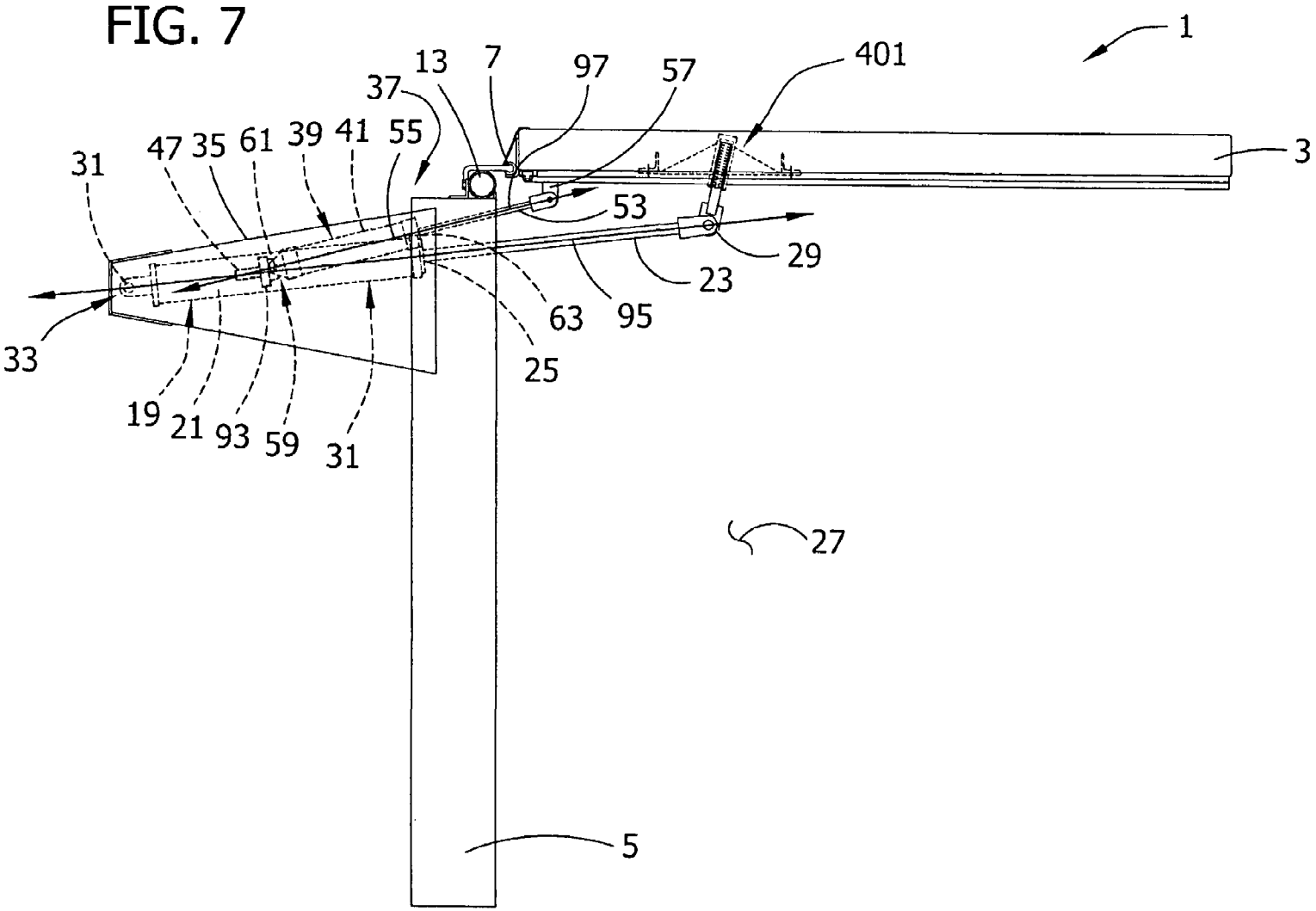
FIG. 7 is a top plan view of the single-leaf door installation of FIGS. 5 and 6 with the leaf being shown in its open position.

The alternative configuration shown in FIGS. 5–7 may be used to provide increased power to the hydraulic checking system 37 if desired. For example, the alternative configuration may be desirable to counter particularly large pressure differential forces. The pneumatic actuator 19 is mounted in substantially the same way as it was in FIGS. 1–3 to maximize the power of the pneumatic actuator 19 available to overcome pressure differential forces. However, the locations for the anchor 59 and leaf connections 57 for the hydraulic checking cylinder 39 are selected to increase the power of the hydraulic checking system 37 available to counter runaway of the door leaf 3 at the time the door leaf 3 is opened just enough to allow substantial equalization of the pressure on opposite sides 15, 17 of the door leaf 3. This will occur relatively quickly after the door leaf 3 begins to move toward the open position. Accordingly, substantial equalization of the pressure on opposite 15, 17 of the door leaf 3 will occur when the door leaf 3 is at an intermediate point on the path from its closed position to its open position, often when the door leaf 3 is between zero and ten degrees from its closed position for example. In order to maximize the power of the hydraulic checking system 37 as the pressure on opposite sides 15, 17 of the door leaf equalize, the locations for the for the hydraulic checking system anchor 59 and clevis connection 57 may be selected to substantially minimize the ratio of the angular velocity of the door leaf 3 to the rate at which the rod 53 of the hydraulic cylinder 39 moves with respect to the hydraulic housing 41. Thus, the hydraulic checking cylinder 39 may be anchored by a pin connection 61 to a bracket 47 welded to the pneumatic cylinder 19, as shown in FIGS. 5–7, so the line of action 97 of the hydraulic checking cylinder 39 is approximately perpendicular to the door leaf 3 when the door leaf is between zero and ten degrees from its closed position. It is often acceptable for the line of action 97 of the hydraulic checking cylinder 39 to be only approximately perpendicular (e.g., within about twenty degrees of perpendicular) to the door leaf 3 when the pressures on opposite sides 15, 17 of the door leaf 3 equalize. As long as the line of action 97 is within twenty degrees of perpendicular to the door leaf 3, for example, the useful component of the force from the hydraulic checking cylinder 39 is still over ninety percent of the magnitude of the total force imparted by the hydraulic checking cylinder. This is often acceptable given the capability of the hydraulic checking system 37 to operate at pressures that are much higher than the pneumatic actuator 19. Those having ordinary skill in the art will understand that it is possible to modify the embodiment shown in FIGS. 5–7 to make the line of action 97 of the hydraulic checking cylinder 39 more perpendicular to the door leaf 3 as the pressures on opposite sides 15, 17 of the door leaf 3 equalize if this is desired to allow use of a smaller hydraulic checking cylinder 39 or to reduce the magnitude of reaction forces at the connections 57, 61 for the hydraulic checking cylinder 39. Also, the hydraulic checking cylinder 39 of the embodiment shown in FIGS. 5–7 is connected to the door leaf 3 relatively close to the vertical pivot axis 99 of the door leaf 3, which allows for a relatively short stroke. Likewise, anchoring the hydraulic checking cylinder 39 to a bracket 47 welded to the pneumatic cylinder 19, as shown in FIG. 5–7, rather than anchoring the hydraulic checking cylinder 39 at the same point as the pneumatic actuator 19 may also permit use of a smaller and less expensive hydraulic checking cylinder 39.

Double-Leaf Door Installation

Figure 8:
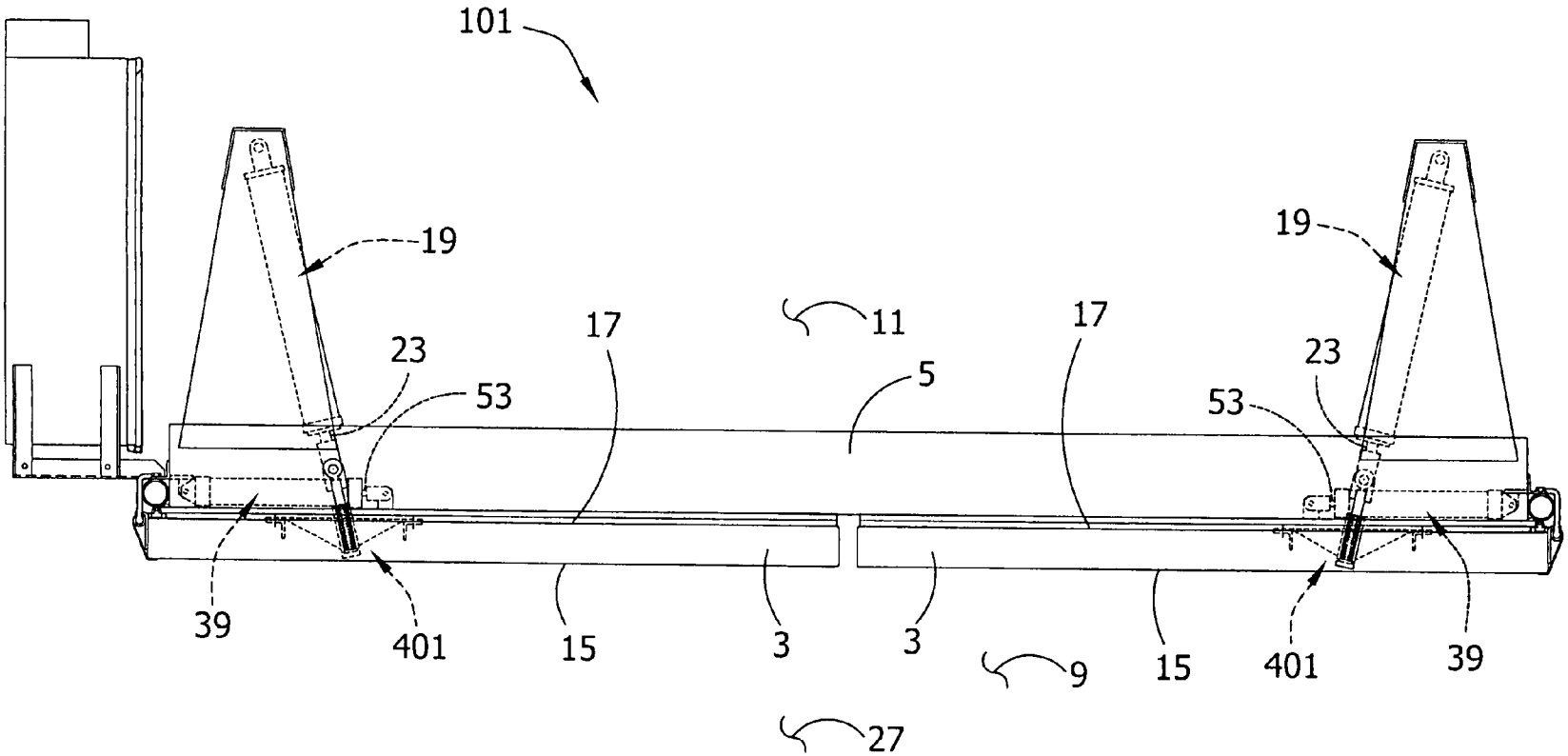
FIG. 8 is a top plan view of a double-leaf door installation of the present invention with the door leafs being shown in their closed positions.
Figure 9:
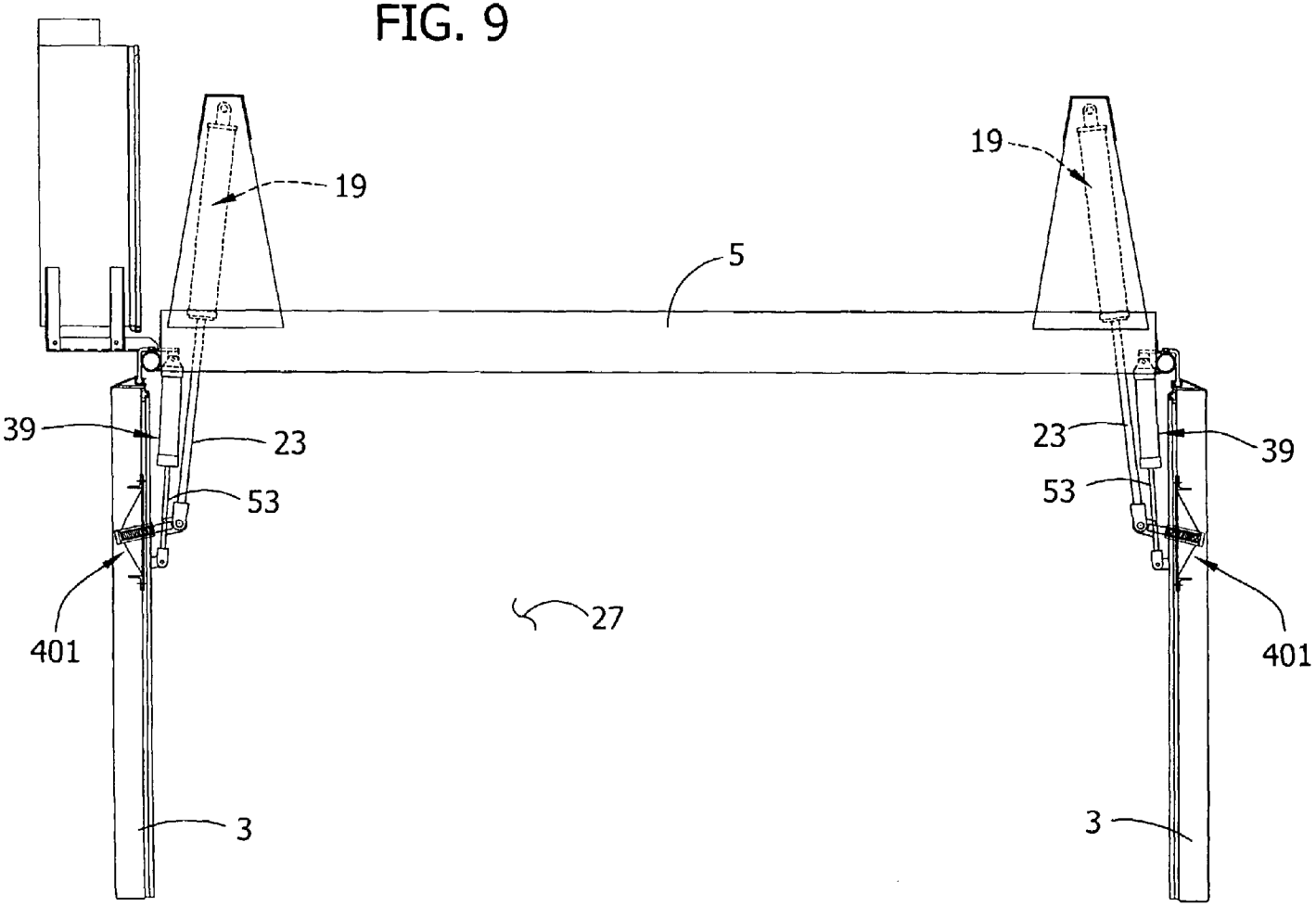
FIG. 9 is a top plan view of the double-leaf door installation of FIG. 8 with the door leafs being shown in their open positions.
Figure 10:
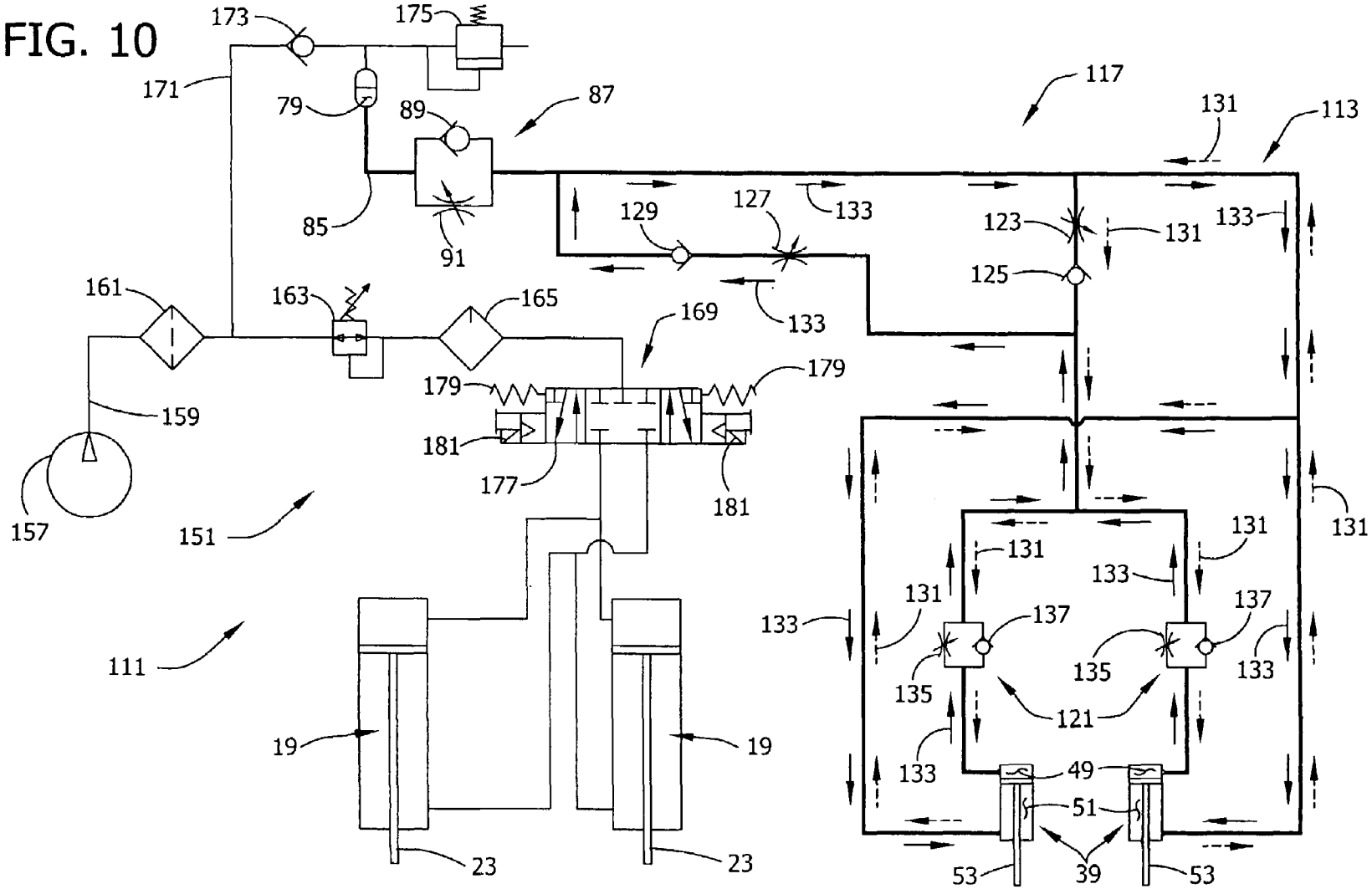
FIG. 10 is a schematic diagram of one hydraulic and pneumatic circuit that is suitable for use in an electrically-controlled double-leaf door installation of the present invention.
Figure 11:
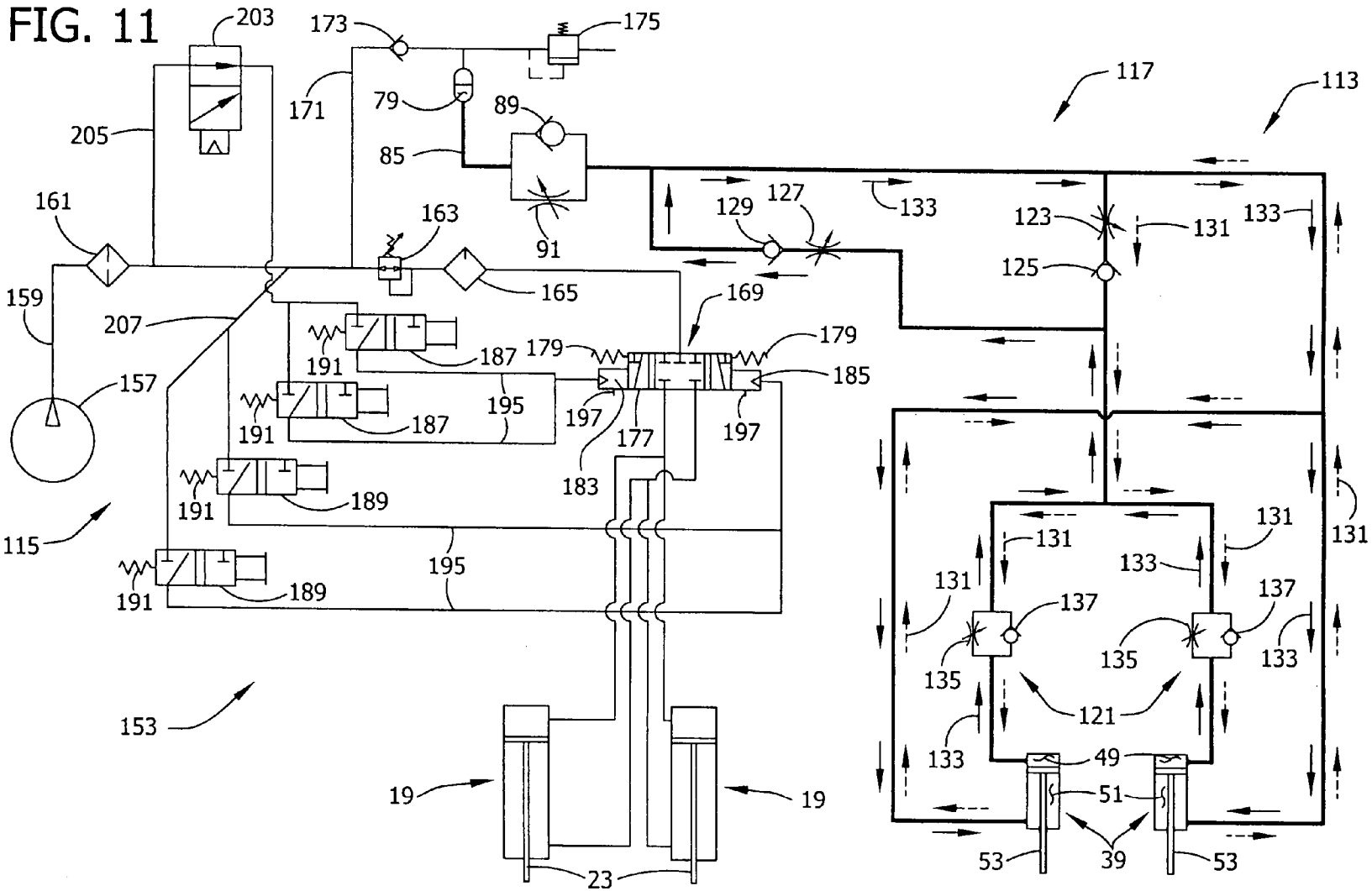
FIG. 11 is a schematic diagram of one hydraulic and pneumatic circuit that is suitable for use in a pneumatically-controlled double-leaf door installation of the present invention.

Most powered mine door installations need to allow passage of heavy machinery and vehicles used in mining. Thus, mine door installations usually have two door leafs to provide a wider passageway through the door. In the following description of double-leaf door installations, a part will be given the same reference number used in the description of the single-leaf embodiments if there is no substantial difference between the part used for the single-leaf embodiments and the double-leaf embodiments. As shown in FIGS. 8 and 9, a double-leaf door installation of the present invention, generally designated 101, comprises two door leafs 3 mounted to opposite columns 13 of a door frame 5 for swinging movement between open and closed positions. Each door leaf 3 has its own pneumatic actuator 19 and hydraulic checking cylinder 39, which operate substantially as described above. Any embodiment described above for a single-leaf door installation can be adapted for use in a double-leaf door installation, including combinations in which one embodiment is adapted for one of the door leafs and a different embodiment is adapted for the other door leaf. However, in the exemplary embodiment shown in FIGS. 8 and 9, the single-leaf embodiment shown in FIGS. 1–3 and discussed above has been used for both door leafs. Also in the embodiment shown in FIGS. 8 and 9 both door leafs 3 open by swinging toward the side 9 of the door leaf 3 subjected to the relatively higher pressure. However, the door leafs 3 could both open by swinging toward the side 11 subjected to relatively low pressure or the door leafs 3 could open by swinging in opposite directions without departing from the scope of this invention. A single control system controls movement of both door leafs 3, as will be discussed below. Likewise, a single pneumatic circuit and a single hydraulic checking circuit are provided for both door leafs 3. FIG. 10 is a schematic representation of a hydraulic 113 and pneumatic circuit 111 suitable for use in a double-leaf door installation 101 of the present invention having an electrical control system 151. FIG. 11 is a schematic representation of a hydraulic 113 and pneumatic circuit 115 suitable for use in a double-leaf door installation 101 of the present invention having a pneumatic control system 153. The hydraulic circuit 113 in FIG. 10 is identical to the hydraulic circuit 113 in FIG. 11.

Referring to FIG. 10, the hydraulic circuit 113 for the double-leaf door installation comprises two hydraulic checking cylinders 39, one connected to each door leaf 3 as described above. The hydraulic circuit 113 further comprises a pressurized hydraulic fluid reservoir 79. The hydraulic circuit 113 provides fluid connection between the blind end and rod end fluid chambers 49, 51 of the hydraulic checking cylinders 39 and fluid connection with the pressurized reservoir 79. The hydraulic circuit comprises a number of devices to control and regulate flow of hydraulic fluid 43 through the hydraulic circuit 113, including two closing sequence flow control valves 121 (e.g., an adjustable needle valve 135 and check valve 137 plumbed in parallel) each having a serial connection to the blind end fluid chamber 49 of one of the hydraulic checking cylinders 39, an opening speed adjustable needle valve 123 having a serial connection to an opening pathway check valve 125, a closing speed adjustable needle valve 127 having a serial connection to a closing pathway check valve 129, and a reservoir flow control valve 87 which comprises an adjustable needle valve 91 and check valve 89 plumbed in parallel. Those having ordinary skill in the art will recognize that ball valves, globe valves, gate valves, spool valves, and many other types of valves could be used in place of the adjustable needle valves 91, 123, 127, 135. Also, the hydraulic circuit 113 depicted in FIGS. 10 and 11 is just one exemplary embodiment. Other hydraulic circuits could be designed to obtain some or all of the advantages disclosed herein without departing from the scope of this invention.

The hydraulic checking circuit 113 for the double-leaf door installation 101 operates much like the hydraulic circuit 65 for the single-leaf door installation 1 in that hydraulic fluid 43 flows along a first fluid pathway 131 when the door leafs 3 open and a second fluid pathway 133 when the door leafs 3 close. When the door leafs 3 are opening, hydraulic fluid 43 generally flows along the opening pathway 131 (indicated by the arrows with broken-line tails in FIGS. 10 and 11), which runs from the rod end fluid chambers 51 of the hydraulic checking cylinders 39, then through the opening speed needle valve 123 and opening path check valve 125, then through the check valves 137 of the sequence flow control valves 121 to the blind end fluid chambers 49 of the hydraulic checking cylinders 39. When the door leafs 3 are closing, hydraulic fluid 43 generally flows along the closing pathway 133 (indicated by the arrows with solid line tails on FIGS. 10 and 11), which runs from the blind end fluid chambers 49 through the adjustable needle valves 135 in the closing sequence flow control valves 121, then through the adjustable closing speed needle valve 127 and closing pathway check valve 129, and then to the rod end fluid chambers 51 of the hydraulic checking cylinders 39. The opening path check valve 125 prevents fluid 43 from flowing through the opening speed adjustable needle valve 123 during closing, and the closing path check valve 129 prevents fluid 43 from flowing through the closing speed adjustable needle valve 127 during opening.

The adjustable needle valves 123, 127, 135 allow great latitude in adjusting the opening and closing speeds of the door leafs 3. The opening speed needle valve 123 can be adjusted to vary the opening speed of the door leafs 3 independent of the closing speed. Similarly, the closing speed needle valve 127 can be adjusted to vary the closing speed of the door leafs 3 independent of the opening speed. The settings of the closing sequence needle valves 135 can be adjusted to vary the rate at which one of the two door leafs 3 closes without affecting the rate at which the other of the two door leafs 3 closes. This feature allows coordinated setting of the closing sequence needle valves 135 to insure that the door leafs 3 close in a desired sequence. For example, if one of the two door leafs 3 has an astragal sealing flap (not shown) that closes against the other of the two door leafs 3, the closing sequence needle valves 135 can be set so the door leafs close in the required sequence. Because the adjustable needle valves 123, 127, 135 allow great variability in the resistance from the hydraulic checking system 117, a door installation having the hydraulic checking circuit 113 of FIGS. 10 and 11 has great versatility in that it can be adapted to operate under many different conditions.

The pressurized reservoir 79 performs similarly to the pressurized reservoir 79 in the single-leaf door installation 1. When the rods 53 are retracting a volume of hydraulic fluid 43 corresponding to the displacement of the rods 53 flows to the pressurized reservoir 79. Conversely, the pressurized reservoir 79 releases enough fluid 43 to fill the hydraulic checking cylinders 39 when the rods 53 extend. Also, whenever the pressure in the rod end fluid chambers 51 drops below the pressure in the pressurized reservoir 79 the check valve 89 in the reservoir flow control valve 87 opens to prevent the pressure in the rod end fluid chambers 51 from dropping below ambient air pressure. Furthermore, the adjustable needle valve 91 in the reservoir flow control valve 87 prevents fluid 43 exiting the rod end fluid chambers 51 during extension of the rods 53 from entering the pressurized reservoir 79 rather than flowing through the opening speed needle valve 123. Thus, the setting for the adjustable needle valve 91 in the reservoir flow control valve 87 is preferably set to be slightly more restrictive that the setting of the opening speed adjustable needle valve 123.

Control System

Control for the double-leaf door installation 101 may be provided either through conventional controls or through one of the control systems illustrated schematically in FIGS. 10 and 11. In FIGS. 10 and 11, the power for the pneumatic actuators 39 is provided by a source of pressurized air 157 (e.g., air compressor). A first air line 159 provides serial connection to a filter 161, regulator 163, and oiler 165 before the compressed air reaches a four-way valve 169. A second air line 171 is connected to the first air line 159 between the filter 161 and the regulator 163. The second air line 171 delivers compressed air to the reservoir 79 to pressurize the reservoir as described above. A check valve 173 in the second air line 171 prevents pressure fluctuations in the pneumatic circuits 111, 115 of FIGS. 10 and 11 during operation of the pneumatic actuators 19 from influencing the pressure of the pressurized reservoir 79. A pressure relief valve 175 is provided to vent the pressurized reservoir 79 if the pressure is too high.

The control system further comprises a mechanism that selectively shifts the spool in the four-way valve 169. Preferably the control valve 169 is biased to its neutral position by springs 179 or the like. When the spool 177 of the four-way valve 169 in FIGS. 10 and 11 is shifted to the right, compressed air flows through the valve 169 and drives extension of the pneumatic actuators 19, which causes the door leafs 3 to open. Conversely, when the spool 177 is shifted to the left, compressed air drives retraction of the pneumatic actuators 19, which causes the door leafs 3 to close. In the embodiment shown in FIG. 10, electric solenoids 181 are used to shift the spool 177. However, electrical switches (not shown) required to control the solenoids 181 may pose an explosion threat in a mine environment. Thus, as shown in FIG. 11, it may be preferable to use two small pneumatic pistons 183, 185 to shift the spool 177. Conveniently, the pneumatic pistons 183, 185 may be powered by the same pressurized air source 157 that powers the pneumatic cylinders 19. The first piston 183 can be operated by either of two operating valves 187 for shifting the spool 177 to the right to open the door leafs 3. The second piston 185 can be operated by either of two operating valves 189 for shifting the spool 177 to the left to close the door leafs 3. Preferably, each side 9, 11 of the door installation has one of the two operating valves 187 for opening the door 101 and one of the two operating valves 189 for closing the door 101. The operating valves 187, 189 may be any suitable valve, but it is contemplated that palm button valves would be used for the operating valves 187, 189. If palm button valves or other similar valves are used for the operating valves 187, 189, they can be biased by springs 191 to the non-operative position so the door leaf stops moving upon release of the operating valves 187, 189. Suitable palm button valves are available as part number MP-JK19459 from Jack Kennedy Metal Products, Inc. of Taylorville, Ill. Those having ordinary skill in the art will recognize that other palm button valves could be used as well.

In practice, long pneumatic hoses 195 would be used for the air supply lines 159, 171 between the operating valves 187, 189 and the four-way valve 169. This is because the operating valves 187, 189 may be one hundred feet or more from the door installation 101 so that opening and closing of the door 101 can be controlled at a location that is conducive to pulling long trains of vehicles through the door installation. Thus, a person at the front of a long line of vehicles does not have to backtrack to the door 101 to close it after the last vehicle passes through. Furthermore, it is desirable for the pressure in the pneumatic circuit 115 to be quite high to provide quick response to the operating valves 187,189. Unfortunately, the combination of high pressure and long pneumatic hoses means there is a delay from the time the operating valves 187, 189 are released to the time the pressure inside the hoses 195 equilibrates, which can create a delay from the time the operating valves 187, 189 are released and the time the door leafs 3 stop moving. Thus, even if the door leafs 3 need to be stopped in an emergency, for example, they will continue to move for a period of time after the operating valves 187, 189 are released. To reduce the response time, a calibrated vent 197 may be provided adjacent each spool-shifting piston 183, 185. The calibrated vents 197 are small enough that they are easily overcome by the pressurized air source 157. However, when the operating valves 187, 189 are released, the calibrated vents 197 quickly vent the pressurized air right at the four-way valve 169 which dramatically decreases the response time of the door leafs 3 to release of the operating valves 187, 189. It is preferable to have the vents 197 as close to the four-way valve 169 as possible to quickly reduce the air pressure acting on the four-way valve. For example, a vent 197 may be formed by inserting a pipe tee at one end of the four-way valve 169. The pipe tee may have a hole drilled through a plug that is screwed into one leg of the tee to form the calibrated vent 197.

Figure 12:
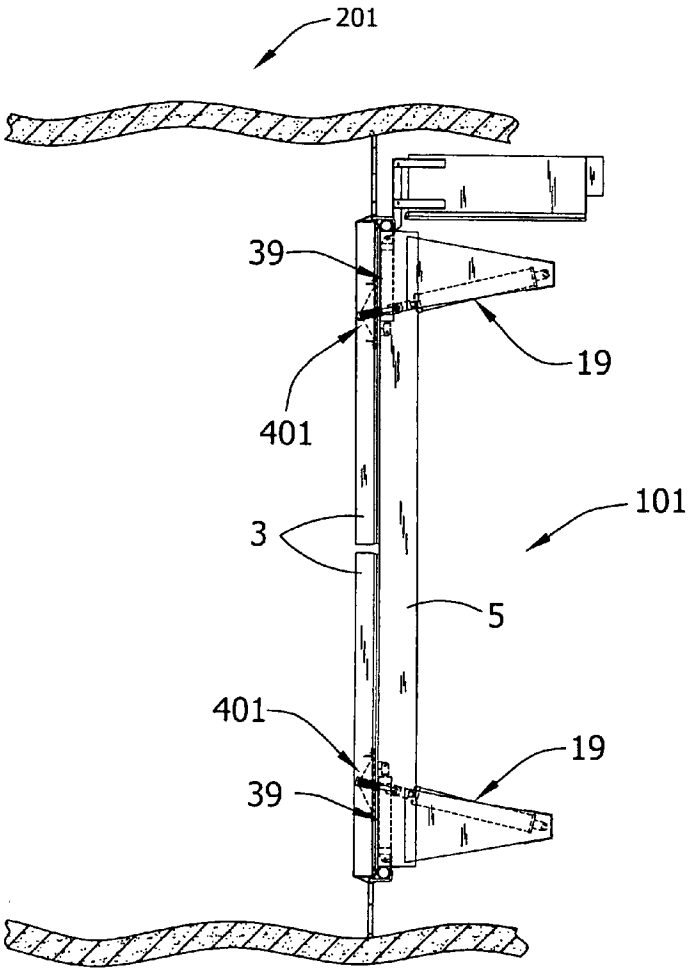
FIG. 12 is a top plan view of an airlock being formed by two double-leaf door installations of the present invention.
Figure 12:
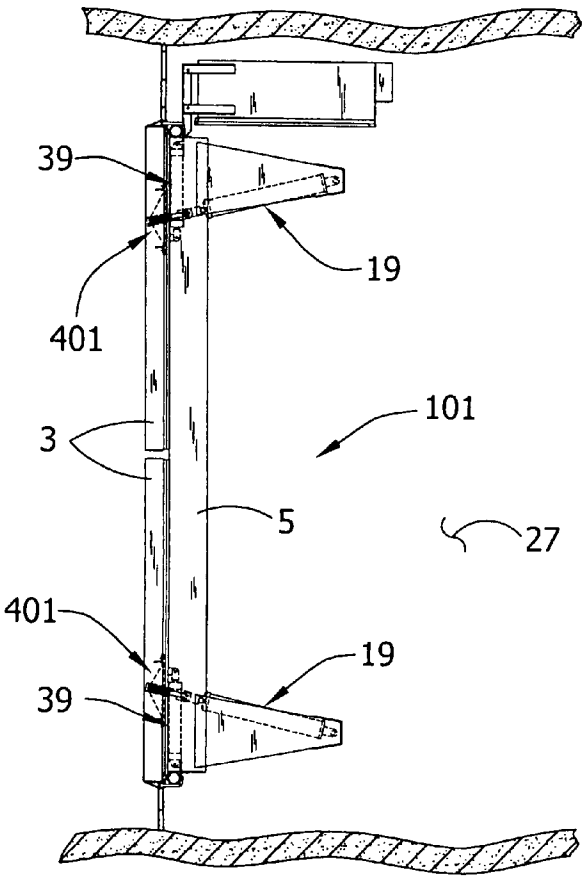

It is also contemplated that two door installations 101 of the present invention may be used together in tandem to create an air lock 201 as shown in FIG. 12. It is a current legal requirement in coal mines, for example, to use air locks in which at least one door installation is closed at any given time. Thus, the pneumatic control circuit 115 shown in FIG. 11 includes a limit valve 203. The limit valve 203 may be a pneumatically-controlled two-way valve, as shown in FIG. 11. However, those having ordinary skill in the art will recognize that other type of valves could also be used for the limit valve 203. The air supply line 205 from the compressor to the opening operating valves 187 is routed through the limit valve 203, which blocks the air supply to the opening operating valves 187 when the other door installation in the air lock 203 is open. Thus, the door installation 101 cannot be opened unless the other door installation is closed. In contrast, the supply line 207 to the closing operating valves is plumbed (routed) around the limit valve 203 so that the door installation 101 can be closed regardless of whether the other door installation is open or closed.

Figure 13:
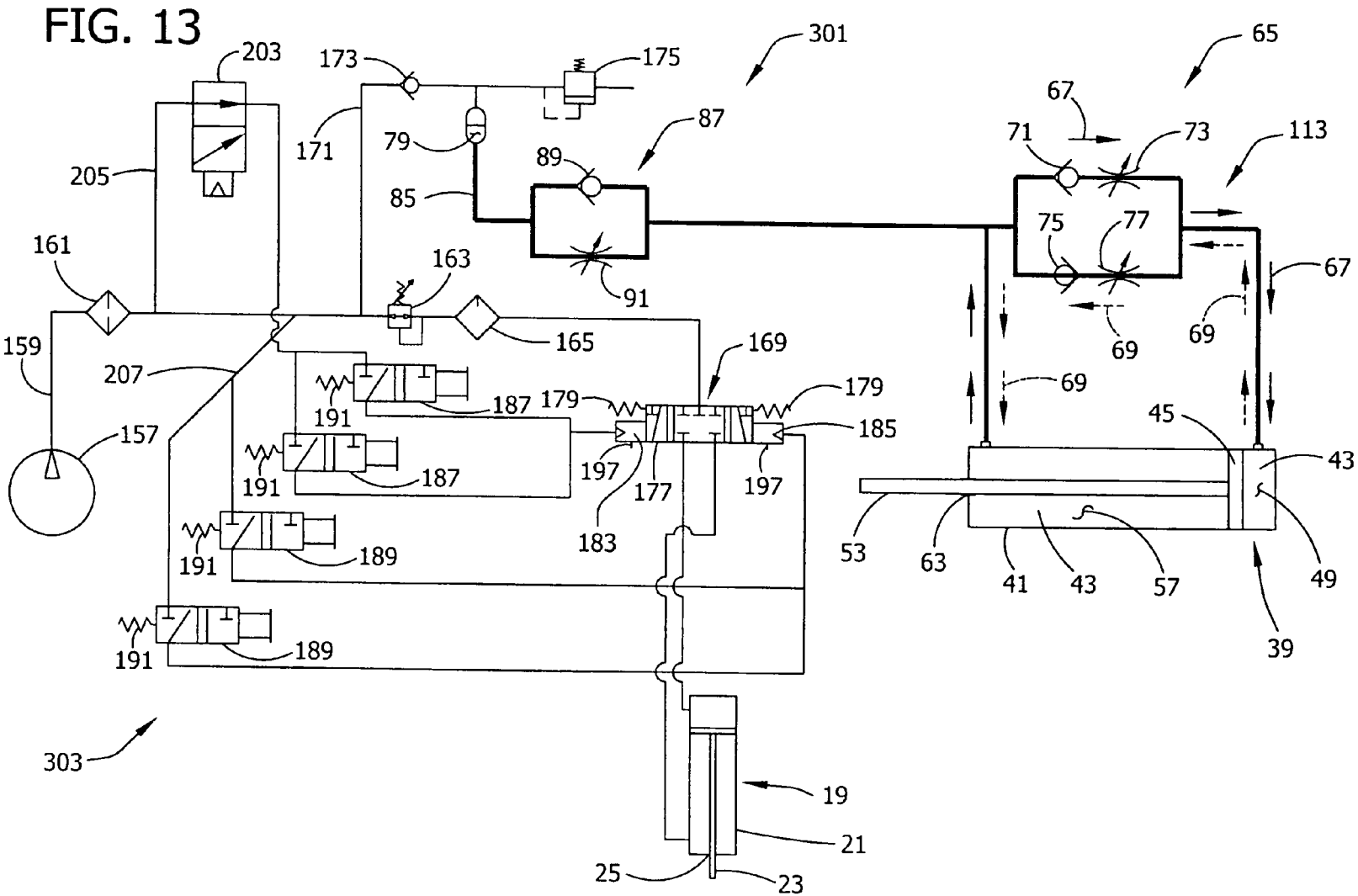
FIG. 13 is a schematic diagram of one hydraulic and pneumatic circuit that is suitable for use in a pneumatically-controlled single-leaf door installation of the present invention.

The control systems 151, 153 shown in FIGS. 10 and 11 are shown as used in connection with double-leaf door installations. However, it is contemplated that advantages of the control systems 151, 153 could also be adapted for use in a single-leaf door installation 1. For example, FIG. 13 shows a pneumatic control system 301 suitable for use in a single-leaf door installation 1 of the present invention. The control system has a pneumatic circuit 303 that is substantially the same as the pneumatic circuit 115 of FIG. 11 with the exception that only one pneumatic cylinder 19 is required since there is only one door leaf 3. Notably, the control system 301 of FIG. 13 has vents 197 to improve response of the door leaf 3 to the operating valves 187, 189. The control system 301 of FIG. 13 has also been equipped with a limit valve 203 that prevents the door leaf 3 from opening if the other door in the air lock 201 is open. The hydraulic circuit 113 of the control system 301 shown in FIG. 13 is identical to the hydraulic circuit 113 shown in FIG. 4. Those having ordinary skill in the art will readily understand from the foregoing that the electric control system 151 of FIG. 10 could be similarly modified to control a single-leaf door installation 1.

When introducing elements of the present invention or the preferred embodiment thereof, the articles "a," "an," "the," and "said" are intended to mean that there are one or more of the elements. The terms "comprising," "including," and "having" are intended to be inclusive and mean that they may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A control system for operating a pneumatically-powered door installation, said control system comprising:

a moveable control valve for selectively supplying air power to one or more actuators to cause swinging movement of one or more door leafs in a door installation in a mine passageway, said moveable control valve being biased toward a first position in which air power is not supplied to the one or more actuators and moveable to a second position in which air power is supplied to the one or more actuators;

a second valve operable to selectively open and close an air supply line between the control valve and a source of compressed air, said control valve being moved to its second position by the compressed air when the air supply line is open; and a calibrated vent for venting the air supply line between the control valve and the second valve.

2. The control system of claim 1 wherein the calibrated vent is located closer to the control valve than the second valve.

3. The control system of claim 1 wherein the calibrated vent is adjacent the control valve.

4. The control system of claim 1 wherein the calibrated vent comprises a hole drilled through a plug screwed into one leg of a pipe tee that is inserted in the air supply line.

5. A control system for operating a pneumatically-powered mine door installation, said control system comprising:

a moveable control valve for selectively supplying air power to one or more actuators to open one or more door leafs in a door installation;

one or more operating valves operable to open and close an air supply line between the control valve and a source of compressed air, said control valve being moved when said air supply line is open to a position supplying air power to said one or more actuators to open the one or more door leafs; and a limit valve which is also operable to open and close said air supply line between the control valve and the source of compressed air, said limit valve being operably linked to a second door installation whereby the air supply line is closed when the second door installation is open.

6. The control system of claim 5 wherein said one or more operating valves includes a second operating valve operable to selectively open or close a second air supply line between the control valve and the source of compressed air, said control valve being moved when said second air supply line is open to a position supplying air power to said one or more actuators to close the one or more door leafs, said second air supply line being plumbed around the limit valve.

* * * * *